US006405527B2

(12) United States Patent
Suzuki et al.

(10) Patent No.: US 6,405,527 B2
(45) Date of Patent: Jun. 18, 2002

(54) FUEL SUPPLY CONROL SYSTEM FOR INTERNAL COMBUSTION ENGINE

(75) Inventors: Norio Suzuki; Toru Kitamura, both of Saitama-ken (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/772,078

(22) Filed: Jan. 30, 2001

(30) Foreign Application Priority Data

Feb. 4, 2000 (JP) ..... 2000-034904

(51) Int. Cl.[7] ..... F01N 3/00

(52) U.S. Cl. ..... 60/285; 60/276; 60/277; 701/109; 123/481

(58) Field of Search ..... 60/274, 277, 276, 60/285; 123/325, 481, 198 F; 701/109

(56) References Cited

U.S. PATENT DOCUMENTS 5,228,286 A * 7/1993 Demura ..... 60/276
5,381,657 A * 1/1995 Takizawa et al. ..... 60/276
5,570,575 A * 11/1996 Sato et al. ..... 60/277
5,661,972 A * 9/1997 Katoh et al. ..... 60/276
5,727,383 A * 3/1998 Yamashita et al. ..... 60/276
5,784,880 A * 7/1998 Toshiro et al. ..... 60/277
6,148,611 A * 11/2000 Sato ..... 60/274

* cited by examiner

*Primary Examiner*—Thomas Denion
*Assistant Examiner*—Binh Tran
(74) *Attorney, Agent, or Firm*—Arent Fox Kintner Plotkin & Kahn, PLLC

(57) ABSTRACT

There is provided a fuel supply control system for an internal combustion engine, which is capable of controlling fuel cutoff according to an amount of oxygen stored in a catalytic converter to thereby enhance the purification rate of the catalytic converter while maintaining excellent fuel economy, thereby making it possible to improve exhaust emission characteristics. An amount of oxygen stored in the catalytic converter 13 arranged in an exhaust pipe 12 of an engine 3 is estimated (steps S1 to S29). A deceleration condition of the engine is detected (steps S35, S36). When the deceleration condition is detected, supply of fuel to the engine is cut off (step S41). The cutoff of fuel supply is controlled based on the oxygen storage amount OSC (steps S31, S32, S40, S41).

4 Claims, 6 Drawing Sheets

FUEL SUPPLY CONROL SYSTEM FOR INTERNAL COMBUSTION ENGINE

BACKGROUND OF THE INVENTION

1. Field of the Invention

This invention relates to a fuel supply control system for an internal combustion engine, which controls the supply and cutoff of fuel to the engine based on the amount of oxygen stored in a catalytic converter which purifies exhaust gases emitted from the engine.

2. Description of the Prior Art

The present assignee proposed an air-fuel ratio control system which controls the air-fuel ratio of an air-fuel mixture to be supplied to an internal combustion engine, based on the amount of oxygen stored in the above catalytic converter, e.g. in Japanese Patent Application No. 5-329780 (corresponding to Japanese Laid-Open Patent Publication (Kokai) No. 7-151002), and a fuel supply control system which carries out the cutoff of fuel (fuel cutoff) to an internal combustion engine during deceleration of the engine, e.g. in Japanese Patent Application No. 7-270736 (corresponding to Japanese Laid-Open Patent Publication (Kokai) No. 9-86227).

In the above air-fuel ratio control system, two O2 sensors (oxygen sensors) are arranged at locations upstream and downstream of a catalytic converter in an exhaust pipe, for detecting the concentration of oxygen in exhaust gases. The amount of oxygen stored in the catalytic converter is estimated based on results of detection performed by the O2 sensors. Then, a desired air-fuel ratio is calculated in dependence on the estimated oxygen storage amount, and the air-fuel ratio of the air-fuel mixture is feedback-controlled such that the air-fuel ratio becomes equal to the desired air-fuel ratio. This makes it possible to control the air-fuel ratio such that the purification rate of the catalytic converter is maximized. On the other hand, in the fuel supply control system, to enhance drivability, fuel cutoff is executed during deceleration of the engine, after a predetermined time period has elapsed from a time point the conditions for carrying out the fuel cutoff were fulfilled. Particularly when deceleration shift is being carried out, the above predetermined time period is shortened to thereby carry out the fuel cutoff promptly after the conditions are fulfilled.

The air-fuel ratio control carried out by the air-fuel ratio control system and the fuel cutoff control executed by the fuel supply control system can attain their respective goals. However, they are carried out separately and independently. Therefore, for instance, when the amount of oxygen stored in the catalytic converter is considered to be large and accordingly the air-fuel ratio is controlled to be richer than a stoichiometric air-fuel ratio, if fuel cutoff is executed, the amount of oxygen stored in the catalytic converter (oxygen storage amount) is further increased, which results in a degraded purification rate of the catalytic converter.

SUMMARY OF THE INVENTION

It is an object of the invention to provide a fuel supply control system for an internal combustion engine, which is capable of controlling fuel cutoff according to the amount of oxygen stored in exhaust gas purification means to thereby enhance the purification rate of the exhaust gas purification means while maintaining excellent fuel economy, thereby making it possible to improve exhaust emission characteristics.

To attain the above object, the present invention provides a fuel supply control system for an internal combustion engine having an exhaust system, for controlling supply of fuel to the engine, comprising:

- exhaust gas purification means arranged in the exhaust system of the engine;
- oxygen storage amount estimation means for estimating an amount of oxygen stored in the exhaust gas purification means, as an oxygen storage amount;
- deceleration condition-detecting means for detecting a deceleration condition of the engine;
- fuel supply cutoff means for cutting off the supply of the fuel to the engine when the deceleration condition-detecting means has detected the deceleration condition; and
- control means for controlling the fuel supply cutoff means based on the oxygen storage amount estimated by the oxygen storage amount estimation means.

According to this fuel supply control system, the fuel supply cutoff means which cuts off the supply of fuel to the engine when the deceleration condition of the internal combustion engine has been detected is controlled based on the amount of oxygen stored in the exhaust gas purification means, which is estimated by the oxygen storage amount estimation means. As described above, the cutoff of supply of fuel to the engine (fuel cutoff) by the fuel supply cutoff means is controlled based on the oxygen storage amount, whereby it is possible to enhance the purification rate of the exhaust gas purification means while maintaining excellent fuel economy. This results in improved exhaust emission characteristics. For instance, when the estimated oxygen storage amount is small, a time period (hereinafter referred to as "the delay time" throughout the specification) between a time point conditions for carrying out fuel cutoff are fulfilled and a time point the fuel cutoff starts to be actually executed is shortened to carry out the fuel cutoff promptly, allowing the oxygen storage amount to be increased. On the other hand, when the estimated oxygen storage amount is large, the delay time is increased to delay execution of the fuel cutoff, thereby making it possible to prevent the oxygen storage amount from being increased. Further, when the oxygen storage amount is increased to a certain amount, the fuel cutoff being performed may be interrupted, thereby making it possible to prevent the oxygen storage amount from being increased to an extremely large amount. As described above, positive use of fuel cutoff is made during deceleration of the engine, whereby it is possible to control an actual amount of oxygen stored in the exhaust gas purification means. This makes it possible to enhance the purification rate of the exhaust gas purification means while maintaining excellent fuel economy.

Preferably, the fuel supply control system includes fuel cutoff inhibition means for inhibiting the fuel supply cutoff means from cutting off the supply of the fuel to the engine, when the oxygen storage amount estimated by the oxygen storage amount estimation means is larger than a predetermined maximum storage amount.

Preferably, the fuel supply control system includes delay time-setting means for setting a delay time over which execution of the cutoff of the supply of the fuel to the engine is delayed, according to the oxygen storage amount.

Preferably, the fuel supply control system includes engine rotational speed-detecting means for detecting a rotational speed of the engine, and intake pipe absolute pressure-detecting means for detecting an intake pipe absolute pressure, and the oxygen storage amount estimation means estimates the oxygen storage amount by adding or subtracting an incremental/decremental value calculated based on a space velocity representative of a volume of exhaust gases, to or from an immediately preceding value of the oxygen storage amount, in accordance with a state of fuel supply control, the space velocity being calculated by using a product of a value of the engine rotational speed detected by the engine rotational speed-detecting means and a value of the intake pipe absolute pressure detected by the intake pipe absolute pressure-detecting means.

The above and other objects, features, and advantages of the invention will become more apparent from the following detailed description taken in conjunction with the accompanying drawings.

DETAILED DESCRIPTION

Figure 1:
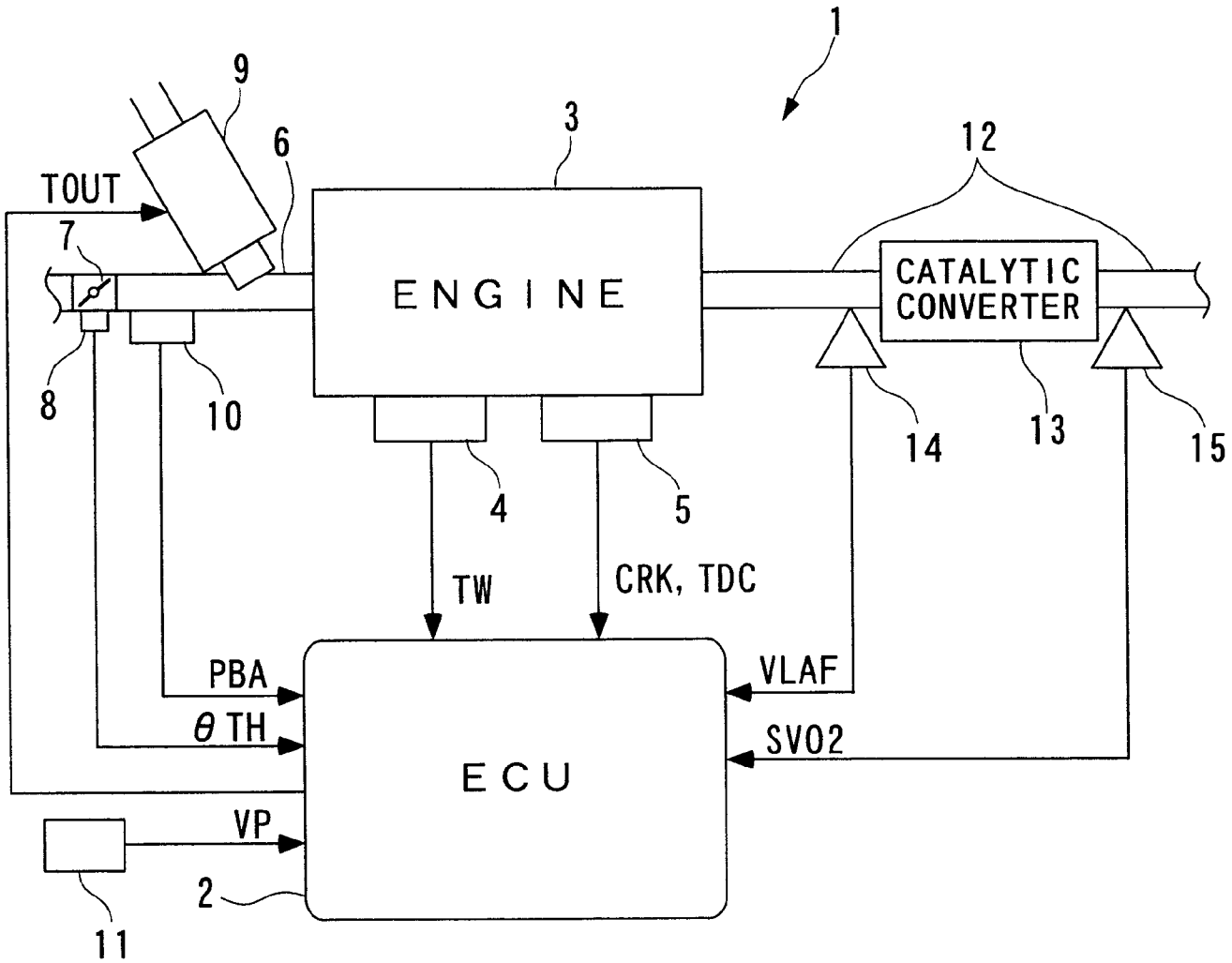
FIG. 1 is a block diagram schematically showing the arrangement of a fuel supply control system according to an embodiment of the invention.

The invention will now be described in detail with reference to the drawings showing an embodiment thereof. Referring first to FIG. 1, there is schematically shown the arrangement of a fuel supply control system for an internal combustion engine, according to an embodiment of the invention. As shown in the figure, the fuel supply control system 1 includes an ECU 2 (oxygen storage amount estimation means, deceleration condition-detecting means, fuel supply cutoff means, control means, fuel cutoff inhibition means, delay time-setting means). The ECU 2 estimates an amount (oxygen storage amount) OSC of oxygen stored in a catalytic converter 13, referred to hereinafter, based on operating conditions of the internal combustion engine (hereinafter simply referred to as "the engine") 3, and controls fuel supply (supply of fuel to the engine 3) and fuel cutoff (cutoff of supply of fuel to the engine 3) based on the estimated oxygen storage amount OSC.

The engine 3 is a straight type four-cylinder gasoline engine, for instance. An engine coolant temperature sensor 4 formed of a thermistor or the like is mounted in a cylinder block of the engine 3. The engine coolant temperature sensor 4 senses an engine coolant temperature TW which is a temperature of an engine coolant circulating within the cylinder block of the engine 3, and supplies an electric signal indicative of the sensed engine coolant temperature TW to the ECU 2. Further, the engine 3 has a crank angle position sensor 5. The crank angle position sensor 5 is a combination of a magnet rotor and an MRE (magnetic resistance element) pickup, and delivers a CRK signal and a TDC signal, both of which are pulse signals, to the ECU 2 whenever a crankshaft, not shown, of the engine 3 rotates through respective predetermined angles. The ECU 2 calculates a rotational speed NE of the engine 3 (engine rotational speed) based on the CRK signal. Each pulse of the TDC signal is generated at a predetermined crank angle position of each cylinder in the vicinity of a top dead center position at the start of an intake stroke of a piston, not shown, in the cylinder whenever the crankshaft rotates through 180 degrees, for instance.

The engine 3 has an intake pipe 6 having a throttle valve 7 arranged therein. Attached to the throttle valve 7 is a throttle valve opening sensor 8 which detects an opening degree θTH (throttle valve opening θTH) of the throttle valve 7 to deliver a signal indicative of the sensed throttle valve opening θTH to the ECU 2. The intake pipe 6 has an injector 9 and an intake pressure sensor 10 inserted therein between the throttle valve 7 and the engine 3. A fuel injection time period TOUT over which the injector 9 injects fuel into the intake pipe 6 is controlled by a drive signal delivered from the ECU 2, whereby the amount of fuel supplied to the engine 3 is controlled. On the other hand, the intake pressure sensor 10 senses an absolute pressure (intake pipe absolute pressure) PBA within the intake pipe 6, and delivers a signal indicative of the sensed absolute pressure PBA to the ECU 2. Further, a vehicle speed sensor 11 for detecting a traveling speed (vehicle speed) VP of an automotive vehicle on which the engine 3 is installed is electrically connected to the ECU 2, and delivers a signal indicative of the sensed vehicle speed VP to the ECU 2.

Arranged in an intermediate portion of an exhaust pipe 12 of the engine 3 is a catalytic converter (three-way catalyst) 13 (exhaust gas purification means) for purifying HC, CO and NOx in exhaust gases emitted from the engine 3 by oxidation-reduction catalytic actions. The catalytic converter 13, which is constructed to adsorb oxygen for storage, adsorbs or releases oxygen depending on the composition of exhaust gases passing therethrough. It should be noted that the maximum value (maximum storage amount OSCMAX) of the oxygen storage amount OSC is determined according to the internal volumetric capacity of the catalytic converter 13 and so forth. Further, oxygen sensors 14, 15 for detecting the concentration of oxygen in exhaust gases are arranged at respective locations upstream and downstream of the catalytic converter 13 in the exhaust pipe 12. The oxygen sensor 14 on the upstream side is comprised of a zirconia element and platinum electrodes, and detects the concentration of oxygen in exhaust gases before being purified by the catalytic converter 13 to generate a signal having a value (output value) VLAF which is indicative of the sensed oxygen concentration and changes linearly as the sensed oxygen concentration changes, and deliver the signal to the ECU 2. Hereafter, the oxygen sensors 14 on the upstream side is referred to as "the LAF sensor 14". On the other hand, the oxygen sensor 15 on the downstream side has a construction generally similar to that of the above LAF sensor 14, and detects the concentration of oxygen in exhaust gases after being purified by the catalytic converter 13 to deliver a signal indicative of the sensed oxygen concentration to the ECU 2. When the air-fuel ratio of an air-fuel mixture is richer than a stoichiometric air-fuel ratio, this signal generated by the oxygen sensor 15 assumes a value (detected value) SVO2 higher than a predetermined reference value SVREF, whereas when the air-fuel ratio is leaner than the stoichiometric fuel-air ratio, the signal assumes a detected value SVO2 lower than the predetermined reference value reference SVREF. Hereinafter, the oxygen sensor 15 on the downstream side is referred to as "the O2 sensor 15".

The ECU 2 is formed by a microcomputer including an I/O interface, a CPU, a RAM, and a ROM, none of which are specifically shown. The RAM is supplied with power by a backup power source such that data stored therein can be preserved even after the engine 3 is stopped. The signals from the above sensors are each input to the CPU after A/D conversion and waveform shaping by the I/O interface. The CPU determines an operating condition of the engine 3 based on these signals, according to a control program read from the ROM, and the like, and estimates the oxygen storage amount OSC of oxygen stored in the catalytic converter 13 based on the determined operating condition. Then, the CPU controls the fuel supply and the fuel cutoff based on the estimated oxygen storage amount OSC.

Figure 2:
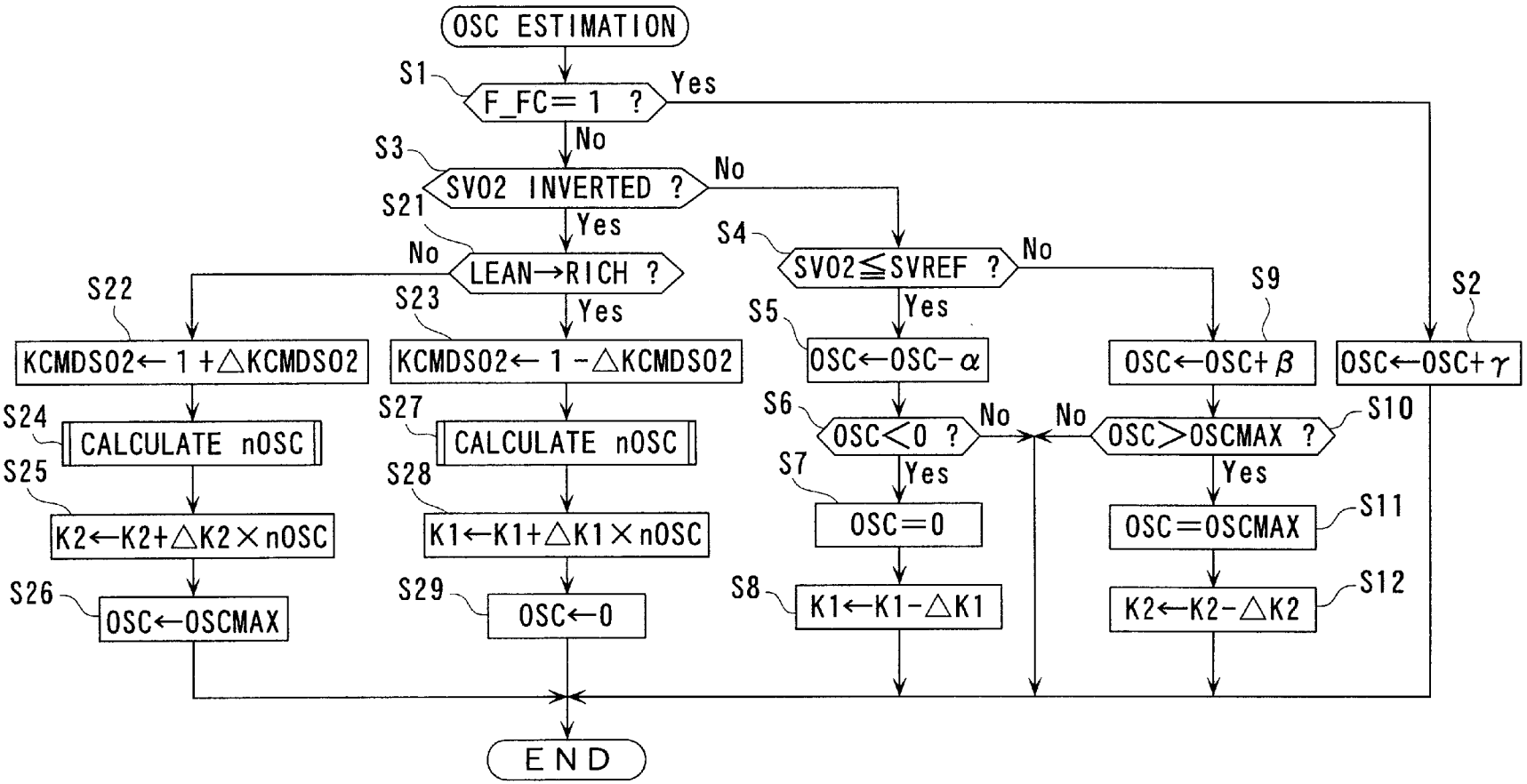
FIG. 2 is a flowchart showing a routine for carrying out an estimation process for estimating an oxygen storage amount OSC.

FIG. 2 is a flowchart showing a routine for carrying out an estimation process for estimating the oxygen storage amount OSC stored in the catalytic converter 13. This process is carried out in synchronism with input of the TDC signal from the crank angle position sensor 5 to the ECU 2. In the process, first, it is determined at a step S1 whether or not a fuel cutoff execution flag F_FC assumes "1". The fuel cutoff execution flag F_FC is set to "1" when the fuel cutoff is carried out (see S42 in FIG. 7). Inversely, when the fuel supply is carried out, the fuel cutoff execution flag F_FC is set to "0" (see S34 in FIG. 7). If the answer to the question of the step S1 is affirmative (Yes), i.e. if fuel cutoff is being carried out to cause air taken in by the engine 3 to flow directly to the catalytic converter 13, the program proceeds to a step S2, wherein an addition term $\gamma$ is added to the oxygen storage amount OSC estimated in the immediately preceding loop for setting the sum to the present oxygen storage amount OSC, followed by terminating the program. The above addition term $\gamma$ is calculated by multiplying a space velocity SV which is representative of an amount of exhaust gases emitted during fuel cutoff, by a predetermined coefficient K3 (e.g. 3) ($\gamma$=SV×K3). It should be noted that the addition term $\gamma$ is set to a value larger than a subtraction term $\alpha$ and an addition term $\beta$, both referred to hereinafter.

On the other hand, if the answer to the question of the step S1 is negative (No), i.e. if it is determined that fuel cutoff is not being carried out, it is determined at a step S3 whether or not the detected value SVO2 of the signal generated by the O2 sensor 15 which detects the concentration of oxygen in exhaust gases purified by the catalytic converter 13 is inverted, that is, whether or not the detected value SVO2 is changed across a value corresponding to the stoichiometric air-fuel ratio between a rich side and a lean side.

If the answer to the question of the step S3 is negative (No), i.e. if the detected value SVO2 is not inverted, it is determined at a step S4 whether or not the detected value SVO2 is equal to or lower than the predetermined reference value SVREF, that is, whether or not the detected value SVO2 has a lean value indicative of a lean air-fuel ratio with respect to the stoichiometric air-fuel ratio. If the answer to the question of the step S4 is affirmative (Yes), i.e. if the detected value SVO2 has a lean value (e.g. from a time t1 up to a time t2 in FIG. 3A), the program proceeds to a step S5, wherein the present oxygen storage amount OSC is set to a value obtained by subtracting the subtraction term $\alpha$ from the oxygen storage amount OSC estimated in the immediately preceding loop. This is because when the detected value SVO2 has a lean value, an air-fuel ratio enrichment control is being carried out, as described hereinafter, so that the amount of oxygen in exhaust gases is decreased, and when the exhaust gases are purified by the catalytic converter 13, the oxygen stored therein is consumed, whereby the oxygen storage amount OSC is decreased.

The above subtraction term $\alpha$ is calculated e.g. by using the following equation (1):

$$\alpha=0.02\times SV\times K1 \tag{1}$$

wherein SV designates a space velocity representative of a volume of exhaust gases, which is calculated by using a product of a detected value of the engine rotational speed NE and a detected value of the intake pipe absolute pressure PBA, and K1 designates a coefficient. The coefficient K1 is set to a value in a range between 0.5 and 1.5.

Figures 3A, 3B, 3C:
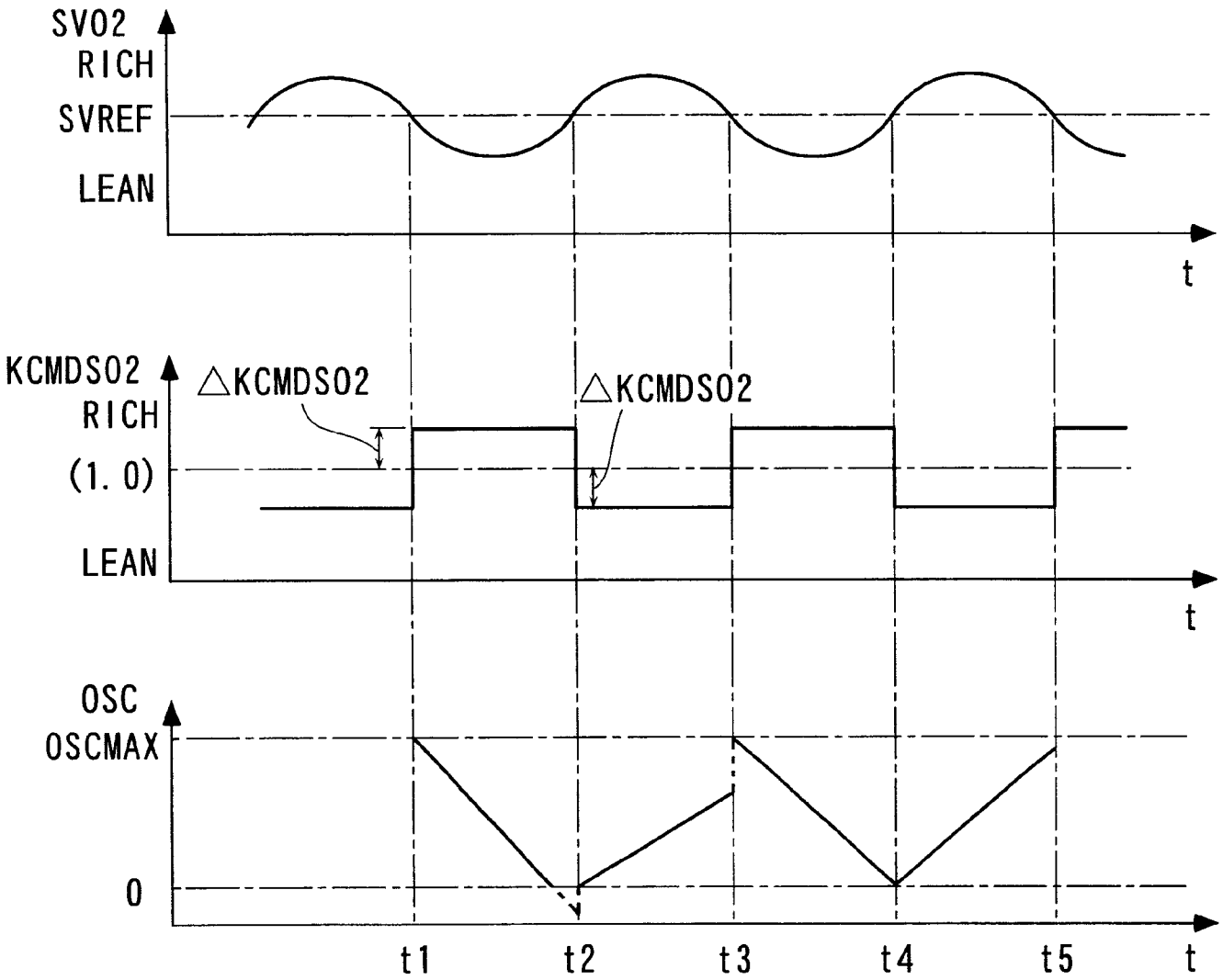
FIG. 3A is a timing chart showing an example of changes in a signal value SVO2 of a signal generated by an O2 sensor.
FIG. 3B is a timing chart showing an example of changes in the setting of an air-fuel ratio correction coefficient KCMDSO2, which corresponds to the FIG. 3A timing chart.
FIG. 3C is a timing chart showing an example of changes in the estimated oxygen storage amount OSC, which corresponds to the FIG. 3A timing chart.

The step S5 is repeatedly carried out, whereby the oxygen storage amount OSC is estimated such that the oxygen storage amount is reduced by the subtraction term $\alpha$ whenever the step S5 is executed (from the time t1 up to the time t2 in FIG. 3C).

Next, the program proceeds to a next step S6, wherein the oxygen storage amount OSC estimated by the above subtraction is subjected to limit checking. That is, it is determined at the step S6 whether or not the oxygen storage amount OSC is smaller than "0". If the answer to the question of the step S6 is negative (No), i.e. if the oxygen storage amount OSC is equal to or larger than "0", the program is immediately terminated, whereas if the answer to the question of the step S6 is affirmative (Yes), i.e. if the oxygen storage amount OSC is smaller than "0" (time t2 in FIG. 3C), the oxygen storage amount OSC is set to "0" at a step S7, and then the subtraction term $\alpha$ which indicates an amount subtracted from the oxygen storage amount OSC is judged to be too large, so that the coefficient K1 is corrected to a value obtained by subtracting a correction value $\Delta$K1 (e.g. 0.05) from the immediately preceding value thereof at a step S8, followed by terminating the program.

On the other hand, if the answer to the question of the step S4 is negative (No), i.e. if the detected value SVO2 has a rich value (from the time t2 up to a time t3 in FIG. 3A), an air-fuel ratio-leaning control is being carried out, as described hereinafter, so that, at a step S9, the present oxygen storage amount OSC is set to a value obtained by adding the addition term $\beta$ to the oxygen storage amount OSC estimated in the immediately preceding loop. This is because the execution of the air-fuel ratio-leaning control increases oxygen in exhaust gases, and oxygen which is not consumed by purification of the exhaust gases by the catalytic converter 13 is stored in the catalytic converter 13 to increase the oxygen storage amount OSC.

The above addition term $\beta$ is calculated e.g. by using the following equation (2):

$$\beta=0.02\times SV\times K2 \tag{2}$$

wherein SV designates the above-mentioned space velocity, and K2 designates a coefficient. The coefficient K2 as well is set to a value within the same value range as that of the coefficient K1.

The step S9 is repeatedly carried out, whereby the oxygen storage amount OSC is estimated such that the oxygen storage amount OSC is increased by the addition term β whenever the step S9 is executed (from the time t2 up to the time t3 in FIG. 3C).

Next, the program proceeds to a step S10, wherein the oxygen storage amount OSC estimated by the above addition is subjected to limit checking. That is, it is determined whether or not the oxygen storage amount OSC is larger than the maximum storage amount OSCMAX. If the answer to the question of the step S10 is negative (No), i.e. if the oxygen storage amount OSC is equal to or smaller than the maximum storage amount OSCMAX, the program is immediately terminated, whereas if the answer to the question of the step S10 is affirmative (Yes), i.e. if the oxygen storage amount OSC is larger than the maximum storage amount OSCMAX, the program proceed to a step S11, wherein the oxygen storage amount OSC is set to the maximum storage amount OSCMAX, and the addition term β which indicates an amount added to the oxygen storage amount OSC is judged to be too large, so that at a step S12, the coefficient K2 is corrected to a value obtained by subtracting a correction value ΔK2 (e.g. 0.05) from the immediately preceding value thereof, followed by terminating the program.

If the answer to the question of the step S3 is affirmative (Yes), i.e. if the detected value SVO2 of the signal generated by the O2 sensor 15 is inverted, it is determined at a step S21 whether or not the inversion of the detected value SVO2 is made from the lean side to the rich side. If the answer to the question of the step S21 is negative (No), i.e. if the detected value SVO2 is inverted from the rich side to the lean side (time t3 in FIG. 3A), the program proceeds to a step S22, wherein an air-fuel ratio correction coefficient KCMDSO2 is set to a value obtained by adding a predetermined correction value ΔKCMDSO2 (e.g. 0.03) to the value "1".

Figure 4:
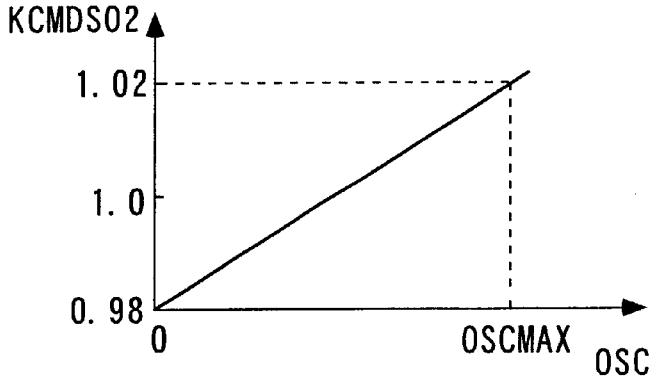
FIG. 4 is a table showing the relationship between the oxygen storage amount OSC and the air-fuel ratio correction coefficient KCMDSO2 in a start mode of the engine.

It should be noted that the above air-fuel ratio correction coefficient KCMDSO2 used for calculating a desired air-fuel ratio coefficient KCMD is calculated based on the oxygen storage amount OSC in a start mode of the engine. This calculation of the air-fuel ratio correction coefficient KCMDSO2 in the start mode of the engine is carried out e.g. by using a table shown in FIG. 4, stored in the ROM. In the table, the air-fuel ratio correction coefficient KCMDSO2 is set such that a value thereof is linearly increased as the oxygen storage amount OSC increases. More specifically, when the oxygen storage amount OSC is equal to the value "0", the air-fuel ratio correction coefficient KCMDSO2 is set to "0.98" slightly smaller than the value "1.0" to thereby supply a slightly lean air-fuel mixture to the engine 3, whereas when the oxygen storage amount OSC is equal to the maximum storage amount OSCMAX, the air-fuel ratio correction coefficient KCMDSO2 is set to "1.02" slightly larger than the value "1.0" to thereby supply a slightly rich air-fuel mixture to the engine 3.

The desired air-fuel ratio coefficient KCMD is calculated by the following equation (3) by using the calculated air-fuel ratio correction coefficient KCMDSO2.

$$KCMD=KCMDTW\times KCMDSO2 \quad (3)$$

The desired air-fuel ratio coefficient KCMD is one of coefficients by which a basic amount of fuel is multiplied for calculation of the fuel injection time period TOUT. Further, the desired air-fuel ratio coefficient KCMD is proportional to the reciprocal of the air-fuel ratio A/F, that is, a fuel-air ratio F/A, and becomes equal to "1.0" when the air-fuel ratio of the air-fuel mixture is equal to the stoichiometric air-fuel ratio.

Figure 5:
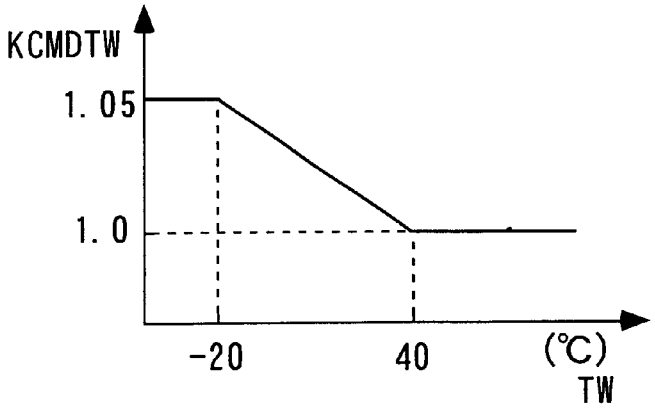
FIG. 5 is a table showing the relationship between an engine coolant temperature TW and a temperature-dependent correction coefficient KCMDTW.

Further, in the above equation (3), KCMDTW designates a temperature-dependent correction coefficient, which is calculated based on the engine coolant temperature TW. The temperature-dependent correction coefficient KCMDTW is calculated by using a table shown in FIG. 5, stored in the ROM. In this table, in order to warm up the engine 3 promptly in a low engine coolant temperature condition, the temperature-dependent correction coefficient KCMDTW is set such that a value thereof becomes larger as the engine coolant temperature TW becomes lower. More specifically, if the engine coolant temperature TW is equal to or lower than −20° C. and equal to or higher than 40° C., the temperature-dependent correction coefficient KCMDTW is set to respective predetermined values of "1.05" and "1.0", whereas if the engine coolant temperature TW is between 40° C. and −20° C., the temperature-dependent correction coefficient KCMDTW is set such that value thereof linearly varies between "1.0" and "1.05". By the temperature-dependent correction coefficient KCMDTW thus set, if the engine coolant temperature TW is lower than 40° C., the desired air-fuel ratio coefficient KCMD is calculated such that the air-fuel ratio of the air-fuel mixture becomes equal to or richer than the stoichiometric air-fuel ratio.

As shown in FIG. 3B, according to the setting of the air-fuel ratio correction coefficient KCMDSO2 carried out at the step S22, the air-fuel ratio correction coefficient KCMDSO2 is held to be "1+ΔKCMDSO2" until a time point the detected value SVO2 of the signal generated by the O2 sensor 15 is inverted to the rich side (between the time t1 and the time t2 in FIG. 3A), whereby the air-fuel ratio of the air-fuel mixture determined according to the desired air-fuel ratio coefficient KCMD is controlled to be richer than the stoichiometric air-fuel ratio.

If the answer to the question of the step S21 is affirmative (Yes), i.e. if the detected value SVO2 is inverted from the lean side to the rich side (time t2 in FIG. 3A), the program proceeds to a step S23, wherein the air-fuel ratio correction coefficient KCMDSO2 is set to a value obtained by subtracting the above-mentioned correction value ΔKCMDSO2 (e.g. 0.03) from the value "1". As shown in FIG. 3B, this causes the air-fuel ratio correction coefficient KCMDSO2 to be held to be "1−ΔKCMDSO2" until a time point the detected value SVO2 is inverted to the lean side (between the time t2 and the time t3 in FIG. 3A), whereby the air-fuel ratio of the air-fuel mixture is controlled to be leaner than the stoichiometric air-fuel ratio.

At a step S24 carried out immediately after the step S22, a storage amount correction coefficient nOSC is calculated based on the difference (OSCMAX-OSC) between the maximum storage amount and the oxygen storage amount. This storage amount correction coefficient nOSC is used to correct the coefficient K2 which is employed for calculating the addition term β added to the oxygen storage amount OSC at the step S9 described above. The storage amount correction coefficient nOSC is determined based on the above difference (OSCMAX-OSC) by using a table shown in FIG. 6, stored in the ROM. In the table, the storage amount correction coefficient nOSC is set such that a value thereof is linearly increased as the difference (OSCMAX-OSC) becomes larger.

Next, at a step S25, the coefficient K2 for calculating the addition term β is corrected by using the storage amount correction coefficient nOSC calculated as above, and then at a step S26, the oxygen storage amount OSC is set to the maximum storage amount OSCMAX, followed by terminating the program.

As described above, when the detected value SVO2 from the O2 sensor 15 is inverted from the rich side to the lean side, the oxygen storage amount OSC is regarded as being equal to the maximum storage amount OSCMAX by the air-fuel ratio-leaning control carried out until the inversion occurs, and at the step S26, the oxygen storage amount OSC is reset to the maximum storage amount OSCMAX. Even if the oxygen storage amount OSC obtained by calculation by the time point of the occurrence of the inversion has not yet reached the maximum storage amount OSCMAX (the time t3 in FIG. 3C) because of a too small value of the addition term β used in calculation of the oxygen storage amount OSC the coefficient K2 used for calculation of the addition term β is corrected to a larger value obtained by adding the product of the correction value ΔK2 and the storage amount correction coefficient nOSC determined based on the above difference (OSCMAX-OSC) to the immediately preceding value of the coefficient K2, whereby it is possible to more suitably estimate the oxygen storage amount OSC thereafter.

Figure 6:
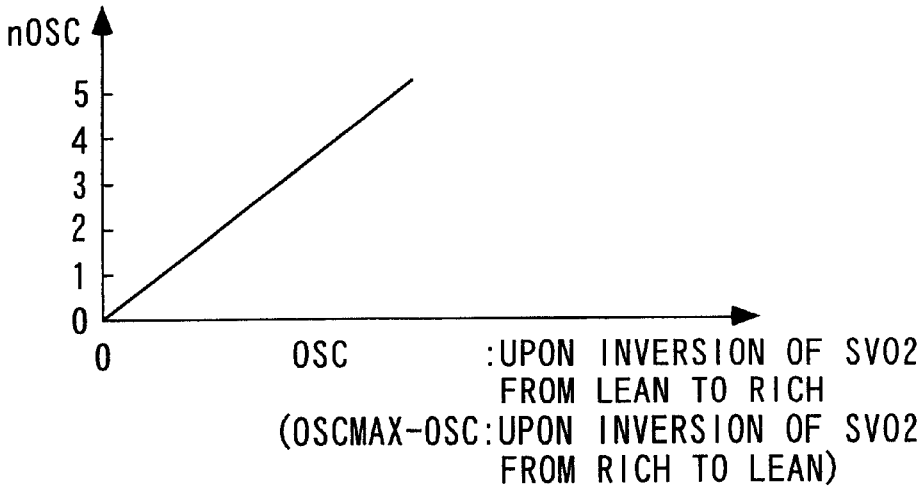
FIG. 6 is a table showing the relationship between the oxygen storage amount OSC and a storage amount correction coefficient nOSC, and the relationship between the difference (OSCMAX-OSC) between the maximum storage amount and the oxygen storage amount and the storage amount correction coefficient nOSC.

At a step S27 carried out immediately after the step S23, the storage amount correction coefficient nOSC is calculated based on the oxygen storage amount OSC by using the FIG. 6 table. In this case, the storage amount correction coefficient nOSC is used for correcting the coefficient K1 which is employed for calculating the subtraction term α subtracted from the oxygen storage amount OSC at the step S5. At the following step S28, the coefficient K1 is corrected by using the calculated storage amount correction coefficient nOSC, and then, the oxygen storage amount OSC is set to the value "0" at a step S29, followed by terminating the program.

As described above, when the detected value SVO2 from the O2 sensor 15 is inverted from the lean side to the rich side, the oxygen storage amount OSC is regarded as being equal to the value "0" by the air-fuel ratio enrichment control carried out until the inversion occurs, and at the step S29, the oxygen storage amount OSC is reset to the value "0". Even if the oxygen storage amount OSC obtained by the time point of the occurrence of the inversion has not yet reached the value "0" because of a too small value of the subtraction term α used in calculation of the oxygen storage amount OSC, the coefficient K1 used for calculation of the subtraction term α is corrected to a larger value obtained by adding the product of the correction value ΔK1 and the storage amount correction coefficient nOSC determined based on the oxygen storage amount OSC to the immediately preceding value of the coefficient K1, whereby it is possible to more suitably estimate the oxygen storage amount OSC thereafter.

Figure 7:
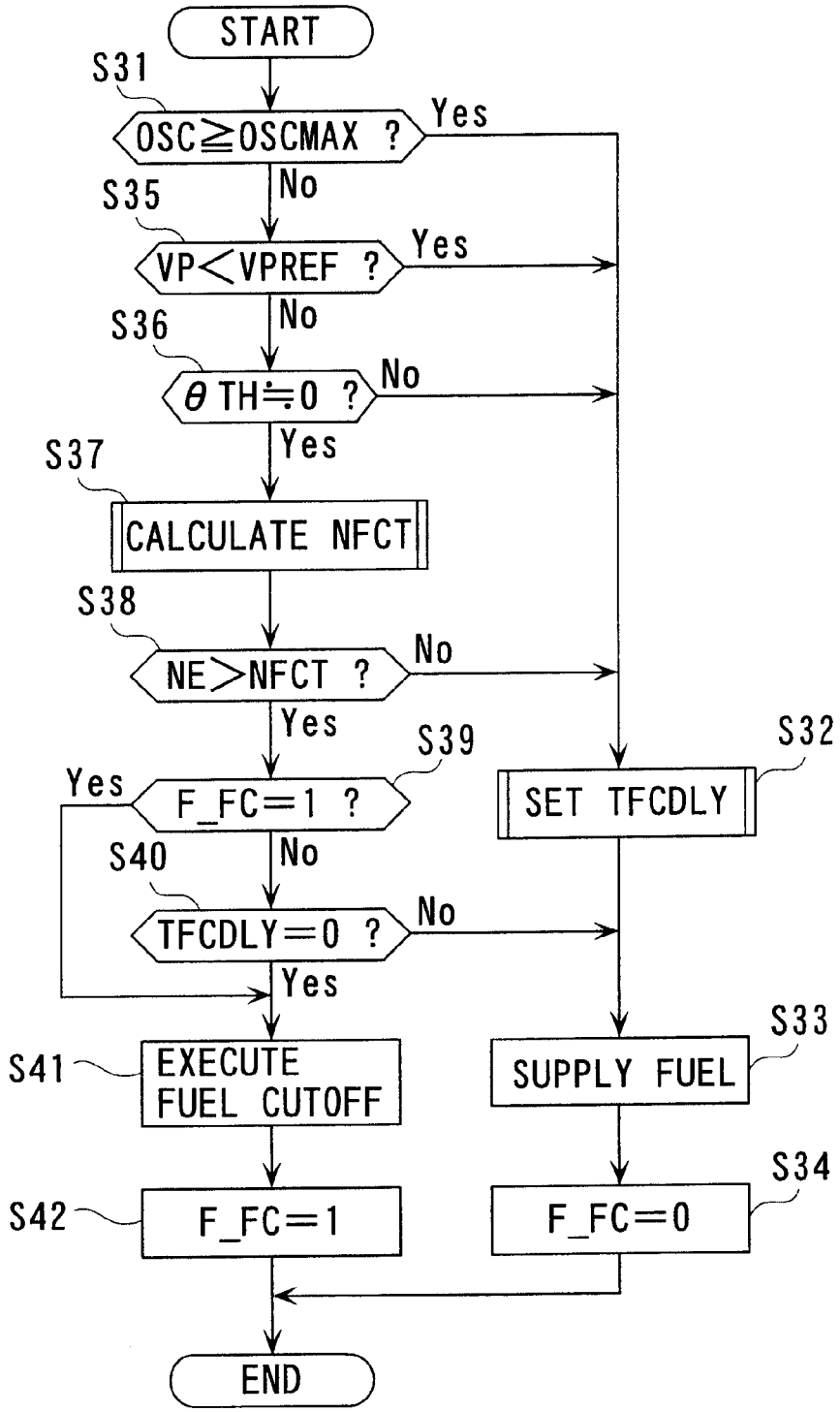
FIG. 7 is a flowchart showing a routine for carrying out a control process carried out by the FIG. 1 fuel supply control system.

Next, a control process for controlling the fuel supply and the fuel cutoff based on the oxygen storage amount OSC estimated as above will be described with reference to a flowchart shown in FIG. 7. Similarly to the above-mentioned estimation process for estimating the oxygen storage amount OSC, this process as well is carried out in synchronism with input of the TDC signal from the crank angle position sensor 5 to the ECU 2. In this process, it is determined at steps S31, S35, S36 and S38 whether or not conditions for carrying out fuel cutoff are fulfilled. More specifically, first of all, it is determined at the step S31 whether or not the oxygen storage amount OSC estimated by carrying out the oxygen storage amount estimation process is equal to or larger than the maximum storage amount OSCMAX. This determination is carried out in order to inhibit execution of fuel cutoff when the oxygen storage amount OSC is equal to or larger than the maximum storage amount OSCMAX, to thereby prevent continuation of a state of the oxygen storage amount OSC being too large. Therefore, if the answer to the question of the step S31 is affirmative (Yes), i.e. if the oxygen storage amount OSC is equal to or larger than the maximum storage amount OSCMAX, it is judged that fuel cutoff should not be carried out, and the program proceeds to a step S32.

At the step S32, a downcount timer is set to a fuel cutoff execution delay time TFCDLY. Then, fuel is supplied to the engine 3 at a step S33, and the fuel cutoff execution flag F_FC is set to "0" at a step S34, followed by terminating the program.

Figure 8:
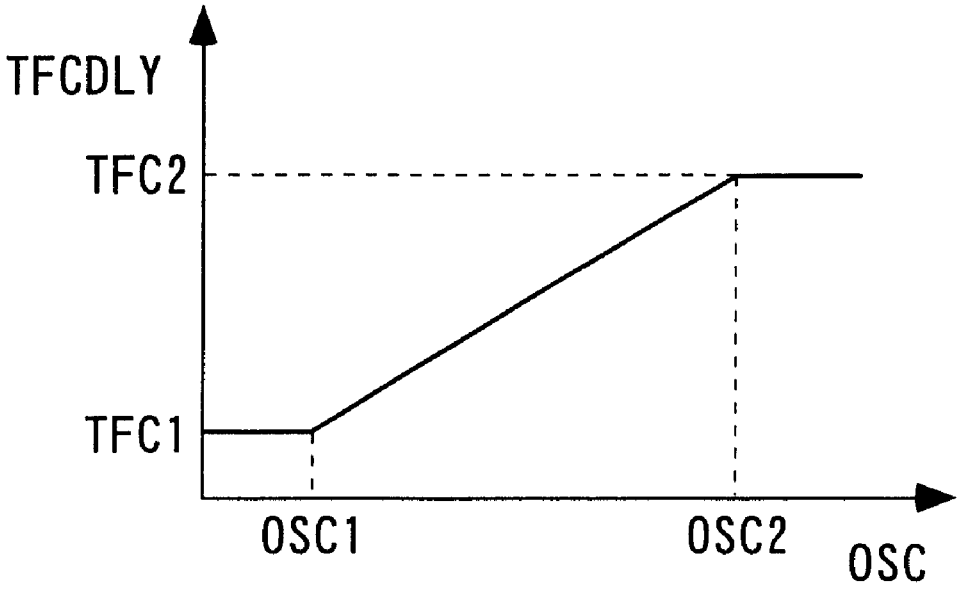
FIG. 8 is a table showing the relationship between the oxygen storage amount OSC and a fuel cutoff execution delay time TFCDLY.

The above fuel cutoff execution delay time TFCDLY indicates a time period between a time point the conditions for carrying out fuel cutoff are fulfilled, as described hereinafter, and a time point the fuel cutoff starts to be actually executed, and set based on the oxygen storage amount OSC by using a table shown in FIG. 8. In this table, the fuel cutoff execution delay time TFCDLY is set such that a value thereof becomes shorter as the oxygen storage amount OSC decreases. More specifically, the fuel cutoff execution delay time TFCDLY is set to a short time period TFC1 (e.g. 5 seconds) when the oxygen storage amount OSC is equal to or smaller than a value indicative of a state of the oxygen storage amount OSC being relatively small, whereas when the oxygen storage amount OSC is equal to or larger than a value OSC2 indicative of a state of the oxygen storage amount OSC being relatively large, the fuel cutoff execution delay time TFCDLY is set to a time period TFC2 (e.g. 25 seconds) longer than the time period TFC1. When the oxygen storage amount OSC assumes a value between the oxygen storage amount OSC1 and the oxygen storage amount OSC2, a value of the fuel cutoff execution delay time TFCDLY is set to change linearly as the value of the oxygen storage amount OSC changes.

If the answer to the question of the step S31 is negative (No), i.e. if the oxygen storage amount OSC is smaller than the maximum storage amount OSCMAX, the program proceeds to the step 35, wherein it is determined whether or not the vehicle speed VP is smaller than a predetermined reference value VPREF (which is low, and e.g. 5 km/h). If the answer to the question of the step S35 is affirmative (Yes), i.e. if the vehicle speed VP is lower than the predetermined value VPREF, it is determined that fuel cutoff should not be carried out, since there is a possibility of occurrence of stalling of the engine 3. Then, the program proceeds to the above step S32 for setting the fuel cutoff execution delay time TFCDLY. Thereafter, fuel is supplied to the engine 3 at the step S33, and the fuel cutoff execution flag F_FC is set to "0" at the step S34, followed by terminating the program.

If the answer to the question of the step S35 is negative (No), i.e. if the vehicle speed VP is equal to or higher than the predetermined value VPREF, it is determined at the next step S36 whether or not the throttle valve opening θTH is approximately equal to "0" degrees, that is, the throttle valve 7 is in a fully closed position. If the answer to the question of the step S36 is negative (No), i.e. if the throttle valve 7 is not in the fully closed position, it is determined that fuel cutoff should not be carried out, since the output power of the engine 3 is demanded. Then, the steps S32, S33 and S34 are carried out, followed by terminating the program. On the other hand, if the answer to the question of the step S36 is affirmative (Yes), i.e. if the throttle valve 7 is in the fully closed position, the program proceeds to the following step S37. By carrying out the above steps S35 and S36, it is determined whether or not the engine 3 is in a deceleration condition.

Figure 9:
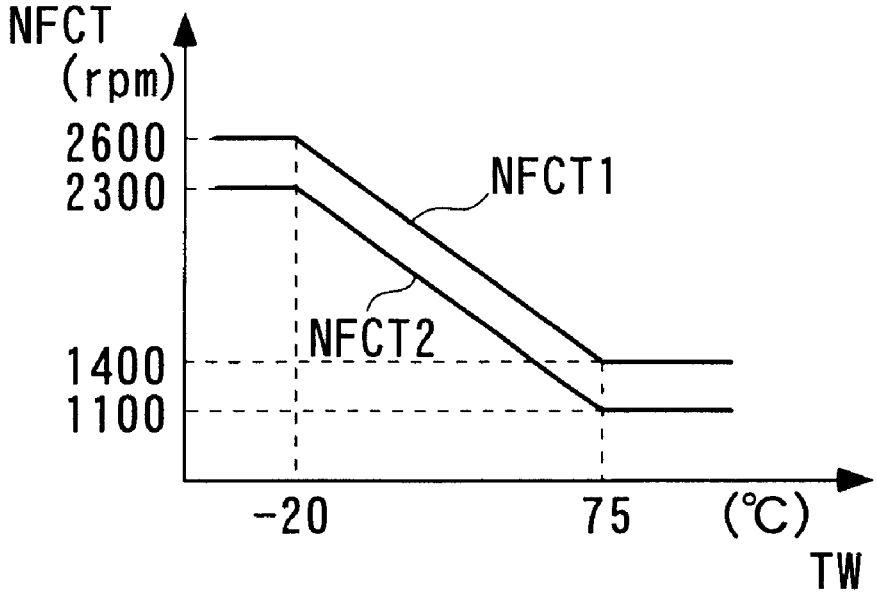
FIG. 9 is a table showing the relationship between the engine coolant temperature TW and a fuel cutoff execution-determining reference speed NFCT.

At the step S37, an engine rotational speed (fuel cutoff execution-determining reference speed) NFCT is calculated based on the engine coolant temperature TW, for use in determining whether or not fuel cutoff should be executed. This calculation is carried out based on the engine coolant temperature TW by using a table shown in FIG. 9, stored in the ROM. In the table, in order to avoid stalling of the engine 3 due to execution of fuel cutoff at a low engine coolant temperature, the fuel cutoff execution-determining reference speed NFCT is set such that a value thereof becomes larger as the engine coolant temperature TW becomes lower. More specifically, the fuel cutoff execution-determining reference speed NFCT is comprised of a fuel cutoff start-determining reference speed NFCT1 and a fuel cutoff continuation-determining reference speed NFCT2, and set such that the fuel cutoff start-determining reference speed NFCT1 and the fuel cutoff continuation-determining reference speed NFCT2 have a predetermined difference therebetween (NTFC2<NTFC1) at the same engine coolant temperature TW. When fuel cutoff is not been carried out (when the fuel cutoff execution flag F_FC assumes "0"), the fuel cutoff execution-determining reference speed NFCT is set to the fuel cutoff start-determining reference speed NFCT1, whereas when fuel cutoff is being carried out (when the fuel cutoff execution flag F_FC assumes "1"), the fuel cutoff execution-determining reference speed NFCT is set to the fuel cutoff continuation-determining reference speed NFCT2. Thus, occurrence of hunting due to execution of fuel cutoff is prevented.

At the step S38, it is determined whether or not the engine rotational speed NE is larger than the fuel cutoff execution-determining reference speed NFCT calculated at the step S37. If the answer to the question of the step S38 is negative (No), i.e. if the engine rotational speed NE is equal to or smaller than the fuel cutoff execution-determining reference speed NFCT, it is determined that fuel cutoff should not be executed, since stalling of the engine 3 can occur due to execution of fuel cutoff. Then, the steps S32, S33 and S34 are carried out, followed by terminating the program.

On the other hand, if the answer to the question of the step S38 is affirmative (Yes), i.e. if the engine rotational speed NE is larger than the fuel cutoff execution-determining reference speed NFCT, and it is determined as results of the determinations at the steps S31, S35, S36 and S38 that the conditions for carrying out fuel cutoff are fulfilled, it is determined at a step S39 whether or not the fuel cutoff execution flag F_FC assumes "1", that is, whether or not fuel cutoff is being carried out. If the answer to the question of the step S39 is negative (No), i.e. if fuel cutoff is not being carried out, the program proceeds to a step S40, wherein it is determined whether or not the fuel cutoff execution delay time TFCDLY set to the downcount timer at the step S32 is equal to the value "0". If the answer to the question of the step S40 is negative (No), i.e. if the fuel cutoff execution delay time TFCDLY has not yet elapsed after the conditions for carrying out fuel cutoff were fulfilled, fuel cutoff is not carried out, but as described above, fuel is supplied to the engine 3 at the step S33, and the fuel cutoff execution flag F_FC is set to "0" at the step S34, followed by terminating the program.

If the answer to the question of the step S40 is affirmative (Yes), i.e. if the fuel cutoff execution delay time TFCDLY has elapsed after the conditions for carrying out fuel cutoff were fulfilled, fuel cutoff is executed at a step S41, and the fuel cutoff execution flag F_FC is set to "1" at a step S42, followed by terminating the program.

If the answer to the question of the step S39 is affirmative (Yes), the step S40 is skipped, fuel cutoff is executed at the step S41, and the fuel cutoff execution flag F_FC is set to "1" at the step S42, followed by terminating the program. Once the fuel cutoff execution flag F_FC is set to "1" at the step S42, the answer to the question of the step S39 becomes affirmative (Yes), and hence the fuel cutoff is continuously carried out so long as the conditions for carrying out the fuel cutoff are fulfilled.

As described above in detail, according to the fuel supply control system 1 of the invention, fuel cutoff is executed on condition that the conditions for carrying out the fuel cutoff, including a condition dependent on the oxygen storage amount OSC (S31), are fulfilled, and that the fuel cutoff execution delay time TFCDLY has elapsed. As described hereinbefore, since the fuel cutoff execution delay time TFCDLY is set to be short when the estimated oxygen storage amount OSC is small, whereby fuel cutoff is carried out promptly, thereby allowing the oxygen storage amount OSC to be increased. Inversely, when the oxygen storage amount OSC is large, the fuel cutoff execution delay time TFCDLY is set to be long, so that execution of fuel cutoff is delayed, thereby preventing the oxygen storage amount OSC from increasing.

Further, the step S31 permits determination of whether or not fuel cutoff should be executed, based on the oxygen storage amount OSC, which is smaller than the maximum storage amount OSCMAX. This makes it possible to prevent the oxygen storage amount OSC from being increased to the maximum storage amount OSCMAX which is excessively large, by interrupting the fuel cutoff being performed.

As described above, positive use of fuel cutoff is made during deceleration of the engine 3, whereby it is possible to control the oxygen storage amount OSC or amount of oxygen actually stored in the catalytic converter 13. This makes it possible to enhance the purification rate of the catalytic converter 13 while maintaining excellent fuel economy, thereby improving exhaust emission characteristics.

The invention is not necessarily limited to the above embodiment, but it can be put into practice in various forms. For instance, when execution of fuel cutoff is being delayed, that is, during a time period between a time point the conditions for carrying out fuel cutoff are fulfilled and a time point the fuel cutoff starts to be actually executed, an air-fuel mixture leaner than before the conditions are fulfilled may be supplied to the engine 3, so as to attain more excellent fuel economy. Further, if diagnoses of failures (for instance, diagnoses of failures of the LAF sensor 14, an EGR control valve, not shown, etc.) which are normally carried out during fuel cutoff have not yet been executed after the start of the engine 3, fuel cutoff may be executed promptly so as to allow the diagnoses to be readily carried out.

It is further understood by those skilled in the art that the foregoing is a preferred embodiment of the invention, and that various changes and modifications may be made without departing from the spirit and scope thereof.

What is claimed is:

1. A fuel supply control system for an internal combustion engine having an exhaust system, for controlling supply of fuel to said engine, comprising:

exhaust gas purification means arranged in said exhaust system of said engine;

oxygen storage amount estimation means for estimating an amount of oxygen stored in said exhaust gas purification means, as an oxygen storage amount;

deceleration condition-detecting means for detecting a deceleration condition of said engine;

fuel supply cutoff means for cutting off said supply of said fuel to said engine when said deceleration condition-detecting means has detected said deceleration condition; and control means for controlling said fuel supply cutoff means based on said oxygen storage amount estimated by said oxygen storage amount estimation means.

2. A fuel supply control system according to claim 1, including fuel cutoff inhibition means for inhibiting said fuel supply cutoff means from cutting off said supply of said fuel to said engine, when said oxygen storage amount estimated by said oxygen storage amount estimation means is larger than a predetermined maximum storage amount.

3. A fuel supply control system according to claim 1, including delay time-setting means for setting a delay time over which execution of said cutoff of said supply of said fuel to said engine is delayed, according to said oxygen storage amount.

4. A fuel supply control system according to claim 1, including engine rotational speed-detecting means for detecting a rotational speed of said engine, and intake pipe absolute pressure-detecting means for detecting an intake pipe absolute pressure, and wherein said oxygen storage amount estimation means estimates said oxygen storage amount by adding or subtracting an incremental/decremental value calculated based on a space velocity representative of a volume of exhaust gases, to or from an immediately preceding value of said oxygen storage amount, in accordance with a state of fuel supply control, said space velocity being calculated by using a product of a value of said engine rotational speed detected by said engine rotational speed-detecting means and a value of said intake pipe absolute pressure detected by said intake pipe absolute pressure-detecting means.

* * * * *